United States Patent [19]

Hoffmann et al.

[11] 4,009,855

[45] Mar. 1, 1977

[54] TRESTLE

[75] Inventors: Joachim Hoffmann; Karl Klinkhammer, both of Bielefeld, Germany

[73] Assignee: Gebr. Dickertmann Hebezeugfabric A.G., Bielefeld, Germany

[22] Filed: Oct. 6, 1975

[21] Appl. No.: 619,853

[30] Foreign Application Priority Data

Oct. 12, 1974 Germany ..... 2448751

[52] U.S. Cl. ..... 248/352; 248/354 P; 248/357

[51] Int. Cl.[2] ..... E04G 25/00

[58] Field of Search ..... 248/351, 352, 354 R, 248/354 P, 357; 254/133, 134; 211/23, 24, 19, 20

[56] References Cited

UNITED STATES PATENTS

| | | | |
|---|---|---|---|
| 698,231 | 4/1902 | Starzman | 211/24 |
| 2,439,854 | 4/1948 | Lipski | 248/352 |
| 2,524,955 | 10/1950 | Borzell et al. | 248/352 |
| 2,637,522 | 5/1953 | Wallace | 254/134 |
| 3,028,145 | 4/1962 | Brand | 254/134 |

FOREIGN PATENTS OR APPLICATIONS

| | | | |
|---|---|---|---|
| 529,206 | 6/1954 | Belgium | 248/357 |
| 697,894 | 1/1931 | France | 248/354 |
| 568,800 | 11/1957 | Italy | 248/357 |
| 580,100 | 4/1958 | Italy | 248/354 P |

*Primary Examiner*—Robert A. Hafer
*Attorney, Agent, or Firm*—Amster & Rothstein

[57] ABSTRACT

A trestle for vehicles, comprising a base for stable support on an erecting or driving surface and having a stand column extending upwardly therefrom, and a support member vertically adjustable in said stand column and adapted to carry the heavy load, characterized in that said support member is provided on an adjusting column which is vertically adjustable and lockable in the stand column, and with a cross beam having mounted thereon two securing and receiving members arranged with a space from each other in the longitudinal direction of the cross beam and adapted to carry, secured in position, the vehicle wheel in addition to a jack lifting fork.

7 Claims, 8 Drawing Figures

Fig.1
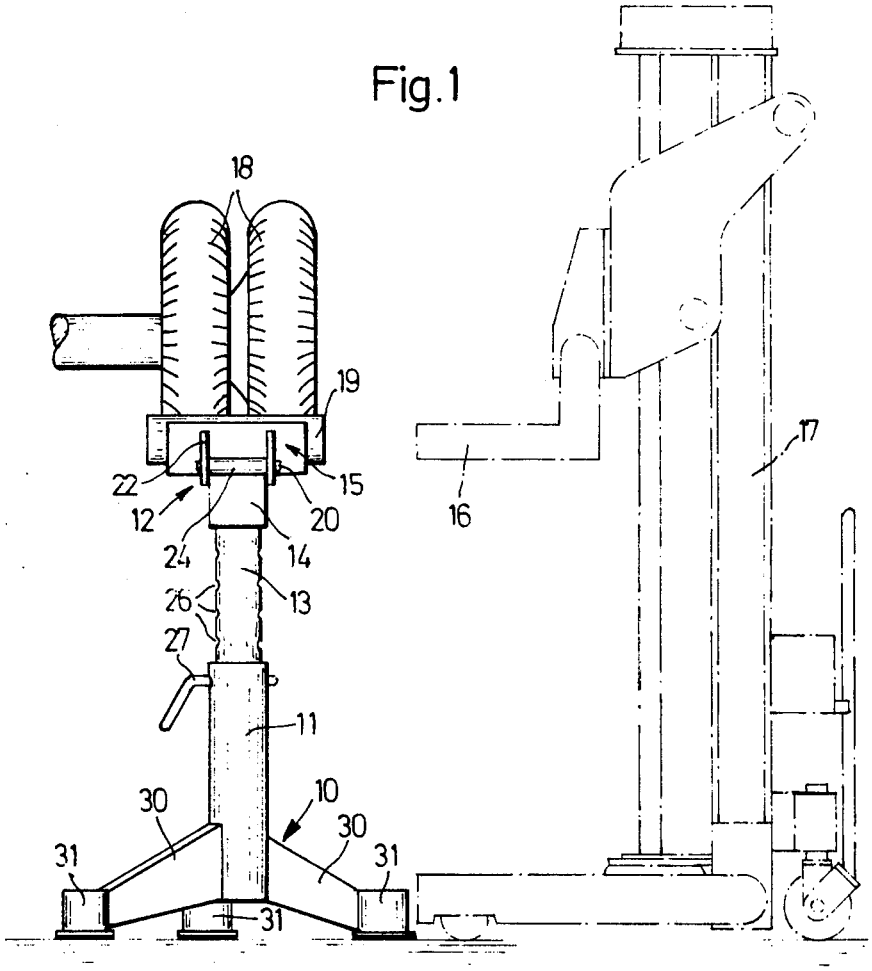
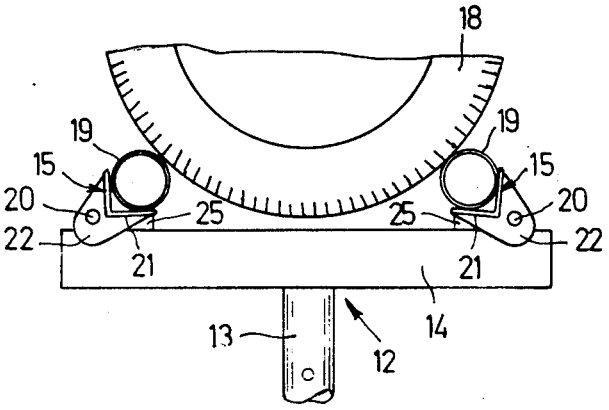
Fig.2

TRESTLE

The present invention concerns a trestle for heavy loads, more particularly for road and rail vehicles, comprising a foot or base part for support on an erecting or driving surface in a stable manner and holding an upright supporting column, and a supporting member vertically adjustable in the supporting column and carrying the raised load.

Such trestles which have become known in various embodiments and serve to support a raised load, are always disposed, in the case of vehicles, in the region of the chassis. A disadvantage is the small area of engagement of the trestles on the chassis, since this area is very narrow and thus the exact positioning of the trestles below the wheels is difficult and time-consuming.

In addition, the trestles in the region of the chassis restrict freedom of access below the vehicle.

It is an object of the invention to provide a trestle which is constructed according to the above-mentioned type and permits the supporting of the raised load with the greatest possible freedom of access below the load and such trestle should be constructed more particularly for vehicles and support them in the region of their wheels.

It is a further object of the invention to provide a trestle with a large supporting surface and to make it very stable in its operating position.

The trestle should be simply, economically and stably constructed and easy to manipulate in conjunction with lifting jacks. Furthermore, it should be easy and simple to adjust vertically to the height of the load as also its width to various wheel diameters.

According to the present invention there is provided a trestle for heavy loads more particularly for road and rail vehicles, comprising a base stably supportable on an erecting or driving surface and holding an upright stand column, and a support member vertically adjustable in said stand column and for carrying the heavy load, characterised in that the support member is provided on an adjusting column which is vertically adjustable and lockable in said stand column and a cross beam having mounted thereon two securing and receiving members arranged with a space from each other in the longitudinal direction of the cross beam and adapted to carry, secured in position, in addition to a jack lifting fork, the load, and more particularly the vehicle wheel.

In both longitudinal end portions of the tubular cross beam, a claw having a channelled supporting and contact surface, may be provided for the hollow sections, whilst both claws facing each other by their supporting and contact surface, are secured to the cross girder with a clearance from each other corresponding to the width of the lifting fork.

It is preferable to mount both claws to be pivotable up and down on the cross beams about an axle extending transversely to the longitudinal direction of the beam and parallel to the longitudinal direction of the channel-like cross section of the supporting and contact surface. Each claw may have an angular profile forming the supporting and contact surfaces and two bearing plates thereon by which the claw is mounted to pivot about the axis contained in a bearing member secured to the cross beam.

The hollow members are preferably formed by tubes having a circular cross-section and the inner diameters of which are larger than the outer cross section of the U shanks of the lifting fork with play and a mobility of the hollow sections about the shanks of the lifting fork.

The adjusting column may be vertically adjustable in the support column with the interposition of a pressure member, preferably a compression spring, and locked in various stages of its vertical position by a locating bolt extending through the supporting and the adjusting columns.

Preferred embodiments will be apparent from the other sub-claims. The scope of protection of the present invention is not limited to the features of the individual claims, but also to combinations thereof.

The trestle of the present invention is simply, economically and stably constructed and provides a reliable support for the raised load. The trestle is particularly intended for supporting raised vehicles and supports said vehicles in the region of their wheels whereby free access below the load in all directions (in the longitudinal and transverse directions of the load) is extremely favourable. The trestles stand directly under the wheels and consequently externally of the chassis of the vehicle, a feature which fully permits access between the wheels in the longitudinal and transverse direction.

The trestle operates by hollow section members engaging below the wheels of the vehicle, said members being received by its claws which have large supporting and contact surfaces, rendering possible easy transfer of the load from the jacks to the trestles. The load is engaged by the hollow sections slipped onto the lifting forks of the jacks and raised and, after the positioning of the trestles below the wheels of the raised vehicles, the trestles lower the load by the hollow sections into the claws of the trestles — then the trestles can be removed with their lifting forks out of the hollow sections without jamming (without friction). The pivotable claws, due to the locatable method of receiving both hollow sections and the simultaneous adjustment of the spacing of the hollow sections to the width of the lifting forks, permit easy insertion and removal into and out of the hollow sections.

Due to the load, both hollow sections are securely and reliably in contact with the claws and the pivotable claws ensure that the hollow sections move into and out of the claws without play.

The tubular hollow sections provide a large contact surface for the wheel and the hollow sections are pressed by the load undisplaceably between both claws of each trestle, a feature which greatly increases the reliability of the support.

The trestle engaging by its locating members directly below the wheels of the vehicle permits greatly improved manipulation because it can be placed very simply, easily and rapidly under the raised load between the lifting forks of the trestle and safely receives the wheel of the vehicle.

The invention will be described further, by way of example, with reference to the accompanying drawings, in which:

FIG. 1 is a front elevation of a trestle in the operating position having vehicle wheels held by means of hollow sections on the supporting member, and of a trestle associated therewith and shown in chain-dotted lines;

FIG. 2 is a fragmentary side elevation of the supporting member with claws receiving the hollow sections secured in position in the loaded condition;

Figure 7:
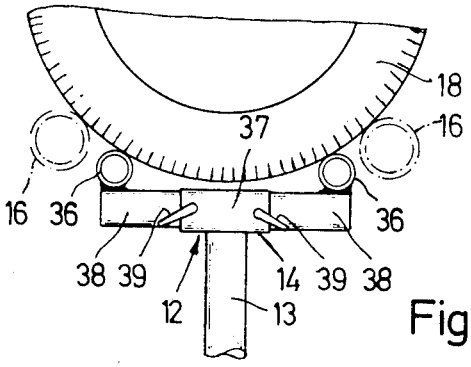
FIG. 7 shows a front view of part of the supporting member having tubular receiving members carrying the vehicle wheel.

A trestle for heavy loads, more particularly road or rail vehicles such as buses, lorries, railway trucks or the like, is provided for carrying the load and more particularly the vehicle wheels 18, with two locating and receiving members 15 or 36 which are provided at a space from each other and are constructed as angular claws 15 or as tubular or box-shaped girders and engage indirectly or directly below the wheel or wheels 18. The trestle has a pedestal or base member 10 stably supported on an erecting or driving surface and is formed by a plate, a tripod or the like. This base member 10 supports an upright and preferably perpendicular column 11 in which a support member 12 for carrying the raised load, is vertically adjustable and lockable in the adjusted vertical position.

The support member 12 is provided on an adjustable column 13 displaceable and lockable in the supporting column 11 and has a cross beam 14 on which there are mounted two claws 15 arranged with a clearance from each other in the longitudinal direction of the beam and receive, fixed in position, two hollow members 19 capable of being slipped on to a lifting fork 16 of a trestle 17 and drawn-off the lifting fork 16 again and carrying the load, more particularly a single or twin wheel vehicle wheel 18.

The cross beam 14 of the supporting member 12 extends longitudinally and at right angles to the vertical direction of the adjusting column 13 and is thus disposed in a horizontal plane. The cross beam 14 is preferably formed by a hollow section such as a four-sided tube (rectangular or square tube) although it may alternatively be formed by angle sections, T or double T-sections or the like.

Both claws 15 preferably have contact and support surfaces 23 having a channelled cross section for the hollow section 19 and extend in the longitudinal direction of the channels transversely (at right angles) to the longitudinal direction of the cross beam 14.

In both longitudinal end sections of the cross beam 14, a claw 15 is mounted to pivot (up and down) about a shaft 20 extending transversely to the longitudinal direction of the cross beam and both claws 15 are opposed to each other by their channelled support and contact surfaces 23; each claw 15 detachably receiving a hollow section 19. Both claws 15 are formed, for example, by respective angle sections 21 and two bearing plates 22 provided thereon; each claw 15 being mounted to pivot about the pivotal axle 20 with its bearing plates 22.

The pivotal axle 20 extends with a slight clearance above the cross beam 14 and is held in a bearing member 24 secured to the cross beam 14. Both shanks of the angle section 21 form the support and contact surface 23 whilst the at least approximately horizontal shank provides the support surface 23 and the at least approximately vertical shank provides the contact surface 23. The support and contact surfaces 23 of both angle sections 21 are opposed to each other and the bearing plates 22 are secured to the outsides of the angle sections 21. Each angle section 21 has a length which ensures a reliable support and contact surface of the hollow section 19 - the length of the angle sections 21 is less than the maximum extension of the basic form of the foot member.

The pivotal motion of the claws 15 is limited on the one hand, by the striking of the upright shank 23 on the cross beam 14 when the claws are swivelled in the direction of the arrow "A" and, on the other hand, by a support member 25 secured to the cross beam 14, with which member the horizontal shank 23 co-operates when swivelled in the direction of the arrow "B" and on which the claw 15 is supported in the carrying condition.

The hollow sections 19 slipped on the lifting fork 16 (constructed with a basic U-shape and formed by sections, more particularly tubes) are preferably formed of tubes having a circular cross section and the inner diameter of the hollow section 19 is greater than the outer diameter of the lifting fork tubes so that there is a certain play in the mounted condition between both tubes 19 and 16.

The adjusting column 13 and the stand column 11 are formed by tubes having a circular or angular cross section and the adjustable column 13 is telescopically insertable in the stand column 11 and extractable therefrom and lockable in stages in the adjusted vertical position of the cross beam 12 carried thereby. For the vertical setting, the adjustable column 13 has a plurality of insertions or openings 26 which are spaced from each other in the longitudinal direction and in which a locking bolt 27 extending through the stand column 11 may be inserted. The bolt 27 detachably engages through bolt columns and may be connected securely to the stand column 11 by a connecting member 28, such as a chain. The locking bolt 27 may be secured against unintentional removal by a plug member **27*a*, such as a cotter pin or the like extending therethrough at its free end and in contact with the column 11**.

In order to facilitate extraction of the adjustable column 13 for vertical adjustment, a compression spring 29 is provided in the stand column 11 and is supported on the bottom **11*a* of the column and against an abutment 13*a* provided in the adjustable column 13. The compression spring 29 is provided with a certain degree of tension resulting in an approximately intermediate position of the adjustable column 13 in its level so that the spring 29, on the one hand, assists in expelling the adjustable column 13 and, on the other hand, enables the column 13 to be inserted in the column 11** by the application of comparatively slight pressure.

Because of the compression spring 29 the adjustable column 13 can be vertically adjusted by the operator using only one hand.

The foot member 10 is preferably formed by a tripod which has three struts 30 secured to the lower portion of the column 11 and projecting radially outwardly therefrom and a stand member 31 at each end of the strut; each stand member 31 is pot-shaped and receives vertically displaceably and guidably, a roller 33 which is subjected to the action of a compression spring 32. In the unloaded condition of the trestle the compression spring 32 presses the roller 33 out of the lower opening of the stand member 31 and the trestle can be moved. When the trestle is loaded, the roller 33 is pressed into the stand member 31 and the trestle stands firmly with its three stand members 31 on the erecting or driving surface.

In order to raise a heavy load, more particularly a vehicle, the lifting jack 17 is used with each trestle, at least four jacks being used for each vehicle and raising the vehicle in the region of its wheels 18. Two hollow profiles 19 are slipped on the U-shaped lifting fork of each jack and they then engage around the U-shanks of the lifting fork 16 and extend parallel to each other with a fixed clearance between them.

The lifting fork 16 of each jack 17 then engages below a wheel 18 by means of the hollow sections 19 and the vehicle is raised by raising the lifting fork 16. The wheels are each supported on the two hollow sections 19 which extend longitudinally parallel to the axle of the wheels.

Figure 4:
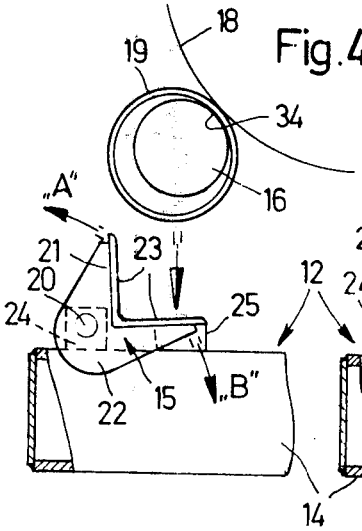
FIGS. 4 to 6 are side views of a portion of the supporting member with one claw and a hollow section, carrying the wheel, in the carrying position by the fork of the trestle, in the carrying position by the claw and the fork of the trestle and in the carrying position by the claw with the release position of the fork of the trestle.

The hollow sections 19 having a larger cross-section than each lifting fork 16 are pressed outwardly and downwardly by the load of the vehicle, so that the fork 16 of each jack 17 engages on the inside of the hollow sections 19 at the top and sides on the inside facing the wheel 18 and the adjacent hollow profile 19 as shown in FIG. 4 of the drawing in the contact area 34.

Figure 5:
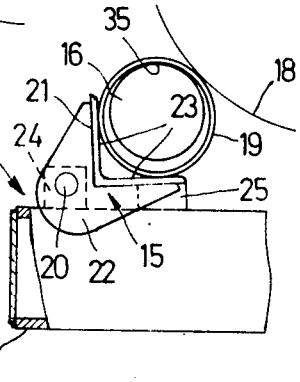

When the vehicle is brought to the desired level, a trestle is placed under each wheel in the region of the hollow sections 19 and the support member 12 thereof adjusted in height. The forks 16 then lower the vehicle onto the trestles, both hollow sections 19 being placed in the two claws 15 of each trestle. The spacing of the claws 15 from each other is adjusted to the spacing of the two shanks of the lifting fork. During the lowering process, the outwardly pressed hollow sections 19 run onto the upright shanks 23 of the angle sections 21 and said angle sections 21 are pivoted slightly upwardly and outwardly at the same time. Due to further lowering of the hollow sections 19 down to the horizontal support surfaces 23, the angle sections 21 pivot downwardly again until they rest on the support members 25. A reduction of the outer spacing of the hollow section 19 relatively to each other then occurs because the upright contact surfaces 23 pivot the hollow sections 19 around the shanks of the fork and then the hollow sections 19 only rest on the lifting fork 16 by their upper portion 35, as shown in FIG. 5. The hollow sections 19 are then in contact with both contact surfaces 23 of each claw 15 and are securely held in position at a space from each other. The lifting fork 16 is then lowered by a further small amount until the shanks of the lifting fork are disposed over their entire cross section with play in the hollow sections 19.

Figure 6:
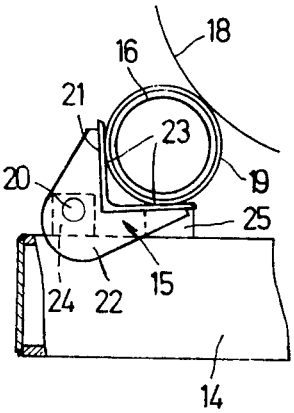

As is shown in FIG. 6, the jack has been moved laterally away from the raised vehicle, the lifting fork 16 being slightly withdrawn from the hollow sections 19. The load (the vehicle) is now supported only by the trestles.

If the vehicle is to be lowered, the lifting forks 16 of the jack are inserted into the two hollow sections 19 of each trestle and raises the vehicle by means of the hollow section until said hollow sections 19 have been withdrawn from the claws 15. Due to the pivotable arrangement of the claws 16, the hollow sections 19 can be freely raised and lowered because the claws 15 permit the pivoting of the hollow sections 19, determined by the load, around the shanks of the lifting fork outwardly or move the hollow sections 19 into the clearance position necessary for the free extraction of the lifting fork 16 out of the hollow section 19.

When the jacks have raised the vehicle, the trestles are free of load and can be removed so that the vehicle can then be lowered.

In embodiments of the invention (not shown), the hollow sections are provided with other cross-sections, that is for example angular (rectangular, square or triangular) oval or C-shaped cross-sections which are constructed according to the cross-sections of the lifting fork but are greater in cross-section.

In other embodiments of the present invention the claws have a partially circular, a prismatic or a U-shaped cross section of their contact and support surface 23.

Figure 8:
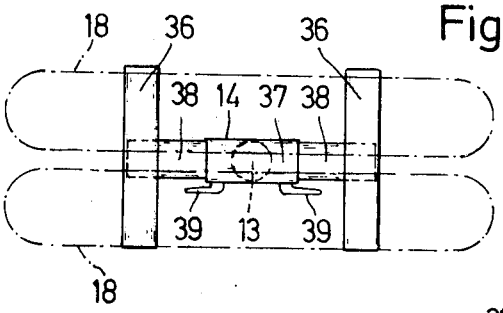
FIG. 8 shows a plan view of the supporting member with longitudinally adjustable cross-beams and chain-dotted wheels.
Figure 3:
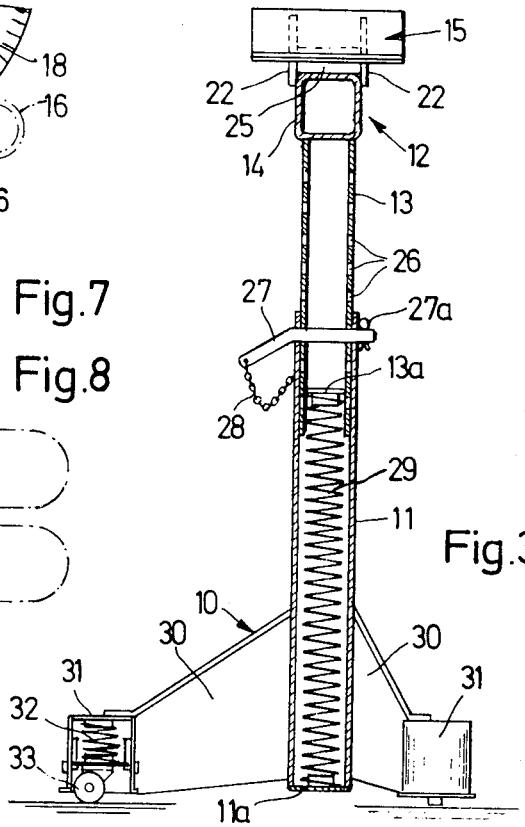
FIG. 3 is a front view of the trestle shown partly in section.

FIGS. 7 and 8 show another embodiment of the trestle of the invention which engages by its tubular locating and receiving members (girders) 36 directly under the wheel or wheels 18 and carries said wheel or wheels so that the additional hollow sections 19 are not necessary. These locating members 36 are secured preferably by welding at both ends of the cross beam 14, and have a length which corresponds at least to the width of two wheels (twin wheels) so that vehicles with double wheels are securely supported by the members 36. The tubular or profiled locating members 36 extend longitudinally at right angles to the longitudinal direction of the cross beam.

Furthermore, the locating and receiving members 36 are formed by bars or angles forming a prismatic receiving trough for the wheels 14. The cross beam 18 is preferably constructed of variable length for adjusting the spacing between the receiving members 15 or 36, so that the trestle of the present invention can reliably carry wheels 18 of different diameters.

At the same time the cross beam 14 can be formed by telescopically insertable tubes or profiles which can be secured infinitely or step-wise relatively to each other. For example, the cross beam 14 may have a center tube 37 which is rigidly connected to the adjusting column 13 and in which two end tubes 38 displaceably engage through which securing means 39, such as clamping screws, bolts or the like may be secured in the inserted or extended position.

The trestle according to FIGS. 7 and 8 is placed below the vehicle wheel 18 outside the area (range) of the jack fork 16 - the trestle is preferably placed between the forks 16 after the vehicle is raised so that both its receiving members 36 are disposed with a clearance from an adjacent fork shank (tine) as shown in FIG. 7. If the trestle is placed under the wheel 18, the lifting fork 16 lowers the vehicle and the wheel or wheels 18 are securely placed on the receiving members 36. The jack can then be removed from the vehicle.

We claim:

1. A supporting trestle for heavy loads, especially road and rail vehicles comprising an upright supporting column having a base portion at the lower end thereof;

a support member mounted so as to vertically adjustable is said supporting column;

said support member including an adjustable column therein and locking means to fix said adjustable column with respect to said supporting column;

a longitudinally extending cross beam secured to an upper end of said adjustable column;

a pair of spaced shafts fixed to said cross beam and extending transversely thereto;

a pair of claws each respectively mounted to pivot on one of said shafts, said claws each including a channeled surface which face each other;

a pair of hollow members of a length sufficient to extend along the length of and be received therein in contact with said channeled surfaces, and said hollow members serving as load supporting members by receiving thereon at least one wheel of the vehicle.

2. A supporting trestle according to claim 1 wherein a pair of bearing members are mounted on said cross beam to each receive one of said shafts therein, said claws each comprise a bearing plate to provide said pivot mounting on one of said respective shafts, and said channeled support is defined by angled sections formed at approximately right angles to each other.

3. A supporting trestle according to claim 2 wherein a pair of abutments are mounted on said cross beam each in respective alignment with one of said claws, said right angled sections of each said claw comprise one section normally in approximately a vertical position and one section normally in a horizontal position, said verticle section limiting pivotal movement of said claw in one direction when it strikes said cross beam, and said horizontal section limiting pivotal movement in the other direction when it strikes said abutment.

4. A supporting trestle according to claim 1 wherein said hollow members are formed as tubes to receive therein tubular members of a listing fork with clearance provided between said tubes and said tubular members.

5. A supporting trestle according to claim 1 wherein said locking means comprises a plurality of vertical openings formed in said adjustable column and a locking bolt mounted to slide through said supporting column into one of said openings.

6. A supporting trestle according to claim 1 wherein a compression spring is located within said supporting column to abut against the bottom of said adjustable column and provide bias thereagainst.

7. A supporting trestle according to claim 1 wherein said supporting column is mounted on a base formed as a tripod with three radially extending struts, a stand member is mounted at the end of each strut, each said stand member formed as an inverted pot having a spring-loader roller therein, said roller being pressed into said pot when said trestle is loaded, and said roller projecting from said pot when said trestle is unloaded to provide for displacing movement of said trestle.

* * * * *